United States Patent [19]

Norström

[11] 4,428,781

[45] Jan. 31, 1984

[54] WELDED STEEL CHAIN

[75] Inventor: Lars Å. Norström, Hagfors, Sweden

[73] Assignee: Uddeholms Aktiebolag, Hagfors, Sweden

[21] Appl. No.: 423,270

[22] Filed: Sep. 24, 1982

[30] Foreign Application Priority Data

Nov. 24, 1981 [SE] Sweden ..... 8106975

[51] Int. Cl.[3] ..... C22C 29/00

[52] U.S. Cl. ..... 148/36; 75/124 B; 75/128 G; 75/128 T; 75/128 V; 59/31; 59/84

[58] Field of Search ..... 148/36, 12 B; 75/124 B, 75/128 A, 128 G, 128 T, 128 W, 128 V; 59/84, 35, 31; 219/51

[56] References Cited

U.S. PATENT DOCUMENTS 3,438,822 10/1966 Allen ..... 148/36

FOREIGN PATENT DOCUMENTS 1608155 7/1970 Fed. Rep. of Germany ... 75/128 G
1278848 12/1959 France ..... 75/128 W
1161056 10/1966 United Kingdom ..... 148/36

*Primary Examiner*—L. Dewayne Rutledge
*Assistant Examiner*—Debbie Yee
*Attorney, Agent, or Firm*—Murray and Whisenhunt

[57] ABSTRACT

A steel with good weldability and hardenability, a yield point of at least 600 MPa, a rupture limit of at least 900 MPa at room temperature and an impact toughness of at least 40 Joule at −20° C., has the following chemical composition as % by weight:

C: 0.03–0.07

Si: 0.10–1

Mn: 1.2–2.5

Cr: 1.8–3

Ni: 1.5–3

Mo: max 0.5

Nb, V, Ti total 0–0.10 with the remainder mainly only iron and impurities in normal amounts. The best impact toughness in achieved when the ratio Mn/Cr is about $\frac{2}{3}$ or 0.6. The total content of Mn+Cr is, in accordance with a preferred embodiment, between 3 and 5, suitably between 3.5 and 4.5%. The steel is particularly suitable for anchor chains for e.g. off-shore oil drilling platforms. A recommended heat treatment after welding includes normalizing at 800°–1000° C., cooling to room temperature and duplex annealing.

17 Claims, 2 Drawing Figures

Impact toughness (Charpy V) at -20°C after hardening 850-870°C/15 min/air cooling

WELDED STEEL CHAIN

TECHNICAL FIELD

The invention relates to a structural and tool steel having good weldability, good hardenability, high tensile strength at room temperature and good impact toughness even at low temperatures. The yield point is at least 600 MPa and the rupture limit is at least 900 MPa, whilst impact toughness at −20° C. is at least 40 Joule. As structural material the steel can be employed in the form of bar, particularly for chains, and in the form of tube for structural tubing. In the machine tool sector the steel can be employed for example for tools for plastic moulding.

BACKGROUND ART

Conventional carbon steels and low-alloy steels are used as structural steels and simpler tool steels. As regards structure, these steels can be subdivided into ferritic-pearlitic steels and martensitic steels. The former steels are weldable but have relatively low mechanical strenght. Using martensitic steels it is possible to achieve considerably greater strenght, but this is normally obtained at the expense of toughness and weldability.

A number of new grades of steel have been developed in order to improve the weldability of the martensitic structural steels and at the same time retain their good strength properties, these being characterised by having a low carbon content whilst at the same time they have as alloy constituents mainly manganese and chromium and generally also some grain refining agents such as niobium, vanadium or titanium. Representative steels appertaining to this category described for example in Swedish patent specification No. 303 885 and in British patent specification Nos. 1 340 744 and 1 353 762. With these and other steels of similar composition important improvements in properties have been achieved in many respects. However the strength requirements imposed on structural steels designed for extremely demanding applications have gradually been increased to values which cannot be complied with by these earlier proposed steels. In particular it has proved difficult with these steels to achieve the desirable impact toughness at low temperatures whilst maintaining good tensile strength. Hardenability too is limited, which restricts the use of the steels for products having large dimensions. Such a product is anchor chain for off-shore oil drilling platforms.

DESCRIPTION OF THE INVENTION

The aim of the invention is to provide a steel having a profile of properties which complies with the requirements listed in the preamble to this patent application. One particular aim is to offer a steel which satisfies the requirements imposed by the off-shore industry for anchor chains.

It is also an objective to provide a steel having relatively low contents of alloying substances so as to maintain overall production costs low. These and other objectives can be achieved if the steel has the following composition expressed as percentages by weight:

TABLE 1

| | |
|---|---|
| C | 0.03–0.07 |
| Si | 0.10–1 |
| Mn | 1.2–2.5 |

TABLE 1-continued

| | |
|---|---|
| Cr | 1.8–3 |
| Ni | 1.5–3 |
| Mo | max 0.5 |
| Nb, V, Ti total | 0–0.10 |

remainder essentially only iron and impurities in normal contents.

Introductory tests have furthermore indicated that the manganese content should preferably be 1.2–2.0, the chromium content 1.8–2.8, the nickel content 1.5–2.5, the molybdenum content 0.2–0.4 and the silicon content 0.2–0.4. The steel can also contain an aluminium content of 0.005–0.04, preferably 0.01–0.02 aluminium. Nitrogen should not be present in more than the normal contents. Niobium, vanadium and titanium can, as specified in the tables above, also be present in contents totaling up to 0–0.10% as grain refining agents. In accordance with the preferred embodiment however these elements should not be present in more than impurity contents.

The tests have also indicated that the effect of nickel in improving toughness depends on the proportion between the manganese and chromium contents, in so far as the effect of the nickel quantity is magnified when the ratio % Mn/% Cr is between 0.5 and 1.0, preferably between 0.5 and 0.75, and is advisably about $\frac{2}{3}$ or 0.6. This observation also leads to the conclusion that the total content of Mn+Cr can be kept comparatively low, 3–5%, advisably 3.5–4.5%, if at the same time the optimum ratio between these two elements is maintained. In order efficiently to take benefit of the toughness improving effect of nickel it is, however, at the present alloy composition, most advantageous if the nickel content is put at a somewhat higher level than has initially been indicated or at 2.0–3.0%.

More particularly we have found that an optimal composition of a steel for anchor chain should be the following as expressed as percentages by weight:

TABLE 2

| | |
|---|---|
| C | 0.030–0.070 |
| Si | 0.25–0.55 |
| Mn | 1.3–1.7 |
| Cr | 2.10–2.70 |
| Ni | 2.35–3.00 |
| Mo | 0.25–0.40 |
| Cu | max 0.20 |
| Al | 0.010–0.025 |
| N | max 0.04 |

balance iron and impurities in normal contents.

In order to achieve the best combination of strength and impact toughness welded anchor chains of steel with an alloy composition according to the invention shoule be subject to the following heat treatment. The welded chain is normalised at a temperature between 800° and 1000° C. and is cooled in air or water to about room temperature. Thereafter the material is duplex annealed, which means that the steel is annealed in the ferritic-austenitic region at a temperature between 680° and 790° C.

BRIEF DESCRIPTION OF DRAWINGS

In the following description of tests which have been made reference will be made to FIG. 1, which illustrates in graph form the impact toughness at −20° C. as a function of the type of steel for the steels investigated, and to FIG. 2 illustrating a link of a chain, in which the positions of test specimens are indicated by dashed lines.

DESCRIPTION OF TESTS MADE AND DETAILS OF THE RESULTS

Figure 1:
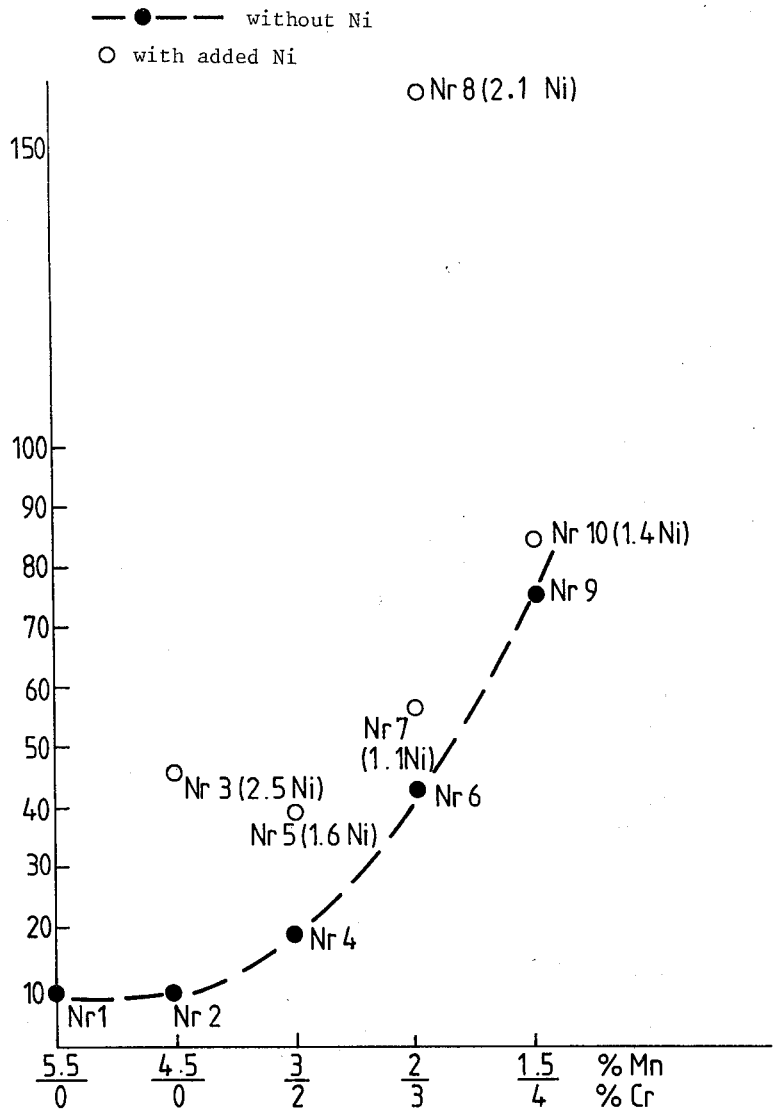

The investigations covered ten 50 kg ingots with a chemical composition as shown in Table 3. The materials investigated comprise alloys with varying quantities of manganese, chromium and/or nickel and were made up in accordance with the following pattern $Mn+Cr \approx 5\%$; % Mn/% Cr: 3/2, 2/3, 1.5/4.
% Ni: 0, 1, 1.5 and 2.
All ten ingots were hot-rolled to form 16 mm diameter bars.

TABLE 3

| | Chemical composition (% by weight) of the steels investigated. | | | | | | | | | |
|---|---|---|---|---|---|---|---|---|---|---|
| Steel no. | C | Si | Mn | Ni | Cr | Nb | Al | N | ΣMn + Cr | Mn/Cr |
| 1 | .029 | .32 | 5.7 | — | — | .05 | .024 | .006 | 5.7 | |
| 2 | .058 | .30 | 4.8 | — | — | — | .031 | .007 | 4.8 | |
| 3 | .054 | .32 | 4.7 | 2.5 | — | .05 | .043 | .005 | 4.7 | |
| 4 | .047 | .33 | 3.1 | — | 2.1 | .06 | .032 | .016 | 5.2 | appr. 3/2 |
| 5 | .051 | .23 | 3.0 | 1.6 | 1.9 | .05 | .012 | .015 | 4.9 | appr. 3/2 |
| 6 | .053 | .32 | 2.0 | — | 3.0 | .06 | .034 | .015 | 5.0 | ⅔ |
| 7 | .055 | .29 | 2.0 | 1.1 | 3.0 | .06 | .031 | .015 | 5.0 | ⅔ |
| 8 | .046 | .24 | 1.9 | 2.1 | 2.9 | .05 | .036 | .012 | 4.8 | appr. ⅔ |
| 9 | .051 | .32 | 1.4 | — | 4.0 | .05 | .042 | .016 | 5.4 | appr. 1.5/4 |
| 10 | .053 | .29 | 1.5 | 1.4 | 3.8 | .05 | .046 | .016 | 5.3 | appr. 1.5/4 |

S = .008–.009 in steels 1–3 and .013–.014 in the remainder
P = .007–.008 in all

From the rolled bars test specimens were manufactured size 16 mm diameter. After normalising at 900° C./15 min/air the materials were hardened in accordance with two alternative methods: 870° C./15 min/-water and 870° C./15 min/air. No tempering was carried out. All steels were subject to tensil testing at RT (room temperature) and were impact tested (Charpy V) at RT, −20° and −40° C. both in the water-quenched and in the air-cooled state. The microstructure of all the steels was studied in the optical microscope.

The microscope studies showed that austenitisation at 870° C./15 min of all these grain-refined materials gave an austenite grain diameter of 20–30μm (ASTM 8–7). After hardening at 870° C./15 min/water quenching all steels exhibited an entirely lath-martensitic structure with a martensite average packet diameter of about 10 μm. After hardening 870° C./15 min/air cooling all the steels exhibited mainly a mixed structure consisting of lath-martensitic with varying mixtures of other structural forms, mainly acicular ferrite (bainite) with relatively high dislocation density. The effective average grain diameter of the high angle boundary grains was about 10 μm. Steel number 3 had the greatest hardenability and an almost completely martensitic structure. In the case of steel number 9, which obviously exhibits the poorest hardenability, there was about 25% by volume of soft polygonal ferrite. Individual inclusions of such ferrite also occurred with steel number 6. In the nickel-alloyed variants having approximately the same Mn/Cr ratio as steels no. 9 and 6, i.e. steels 7 and 8 and 10, no polygonal ferrite was established.

Studies of the water-quenched test specimens as regards their tensile strength and impact toughness showed that rupture limits exceeding 1000–1100 MPa were achieved by all steels. All the steels, apart from steel no. 1, also satisfied the requirements imposed concerning impact toughness at −20° C.

The mechanical properties of the materials hardened from 870° C./15 min/air cooling are listed in Table 4. Furthermore, the impact toughness values at −20° C. have been plotted in the diagram in FIG. 1 as a function of the type of steel. All the steels achieved a rupture strength of well over 900 MPa at room temperature. No well-defined yield point could be observed with these steels and Rp 0.2 is roughly 750 MPa for all steels except in the case of steels 3 and 9, which is a typical strength level for steels of mixed structure of the type involved. Steel no. 9 had a relatively low rupture strength and the lowest Rp 0.2 value of 660 MPa, which is likely to be ascribable to the large amount of soft ferrite in its structure. All steels exhibited lower impact toughness after air cooling than after water quenching, in spite of the fact that the effective grain size was roughly the same and the furthermore water quenching gives higher yield points. Steels 1 and 2 having 5.7% and 4.8% Mn respectively obviously possess catastrophically low impact toughness, which completely can be attributed to austenite grain boundary embrittlement because of the slow air cooling. Embrittlement is recognisable in the form of 100% austenite grain boundary rupture during impact testing. With steel no. 4 the impact toughness is obviously better and there are only isolated occasions of austenite grain boundary rupture. On the other hand it was not possible to detect any sign of austenite grain boundary rupture, but only ductile rupture and the normally present transcrystalline cleavage fracture, with steels 6 and 9, which at the same time exhibit even better impact toughness than steel no. 4.

Nor was it possible to detect any sign whatever of austenite grain boundary rupture in the facture surfaces of the nickel-alloyed variants. The improvements in impact toughness obtained by adding nickel with steels 3 and 5 having more than 3% Mn, can consequently be ascribed mainly to the fact that grain boundary embrittlement has disappeared. Obviously the additions of nickel also resulted in improved impact toughness in steels with less than 3% Mn, which here can be ascribed completely to the effect of nickel in inhibiting cleavage fracture. Hence from the toughness viewpoint the addition of nickel in accordance with the invention is particularly favourable if the material is to be used in the air cooled state. The striking effects of on the one hand the Mn/Cr ratio and the nickel content as regards impact toughness have been illustrated in a graphical manner in the diagram which illustrates in a telling manner the striking effects of nickel when the aim is to improve the impact toughness of a steel having well balanced proportions as between manganese and chromium, more particularly a manganese/chromium ratio of about ⅔, as in the case of steel no. 8 which has a composition which is conceivable in accordance with the invention. The investigation thus indicate that to a great extent it is the ratio between the manganese and chromium contents which stimulates the effect of nickel in increasing toughness more so than the total content of chromium and manganese. Hence it is possible to draw the conclusion from the investigations that an optimum alloy composition can and should have a somewhat lower chromium and manganese content, preferably totalling about 4% of these substances.

TABLE 4

Results of tensile testing at RT and impact toughness testing (Charpy V) on 16 mm diameter bar in the air-cooled untempered state after normalisation at 900° C./15 min/air plus hardening at 850° C./15 min/air (steels 1-3) and 870° C./15 min/air (steels 4-10)

| Steel no. | Rp 0.2 MPa | Rm MPa | A5 % | A10 % | Z % | Impact toughness Joule, at −20° C. | |
|---|---|---|---|---|---|---|---|
| 1 | 760 | 975 | 15 | 9 | 73 | 10 | 9 |
| 2 | 770 | 1020 | 15 | 9 | 70 | 9 | 8 |
| 3 | 885 | 1150 | 14 | 8 | 68 | 51 | 41 |
| 4 | 710 | 1050 | 14 | 9 | 69 | 20 | 18 |
| 5 | 750 | 1110 | 15 | 9 | 67 | 46 | 32 |
| 6 | 730 | 1070 | 15 | 9 | 70 | 58 | 29 |
| 7 | 750 | 1100 | 14 | 9 | 67 | 57 | 56 |
| 8 | 770 | 1100 | 14 | 9 | 70 | 162 | 152 |
| 9 | 660 | 990 | — | 9 | 67 | 84 | 66 |
| 10 | 790 | 1150 | 13 | 8 | 64 | 94 | 74 |

Guided by the experiences from the above disclosed experiments a steel was designed, the nominal composition of which is given in Table 5. Sixty tons of this steel (charge DV 26933) were produced in an arc furnace. The melt was vacuum degassed in an ASEA-SKF vacuum furnace and obtained the following composition, Table 5.

TABLE 5

| Charge | C | Si | Mn | P | S | Cr | Ni | Mo | Cu | Al | N | Fe |
|---|---|---|---|---|---|---|---|---|---|---|---|---|
| DV 26993 | .042 | .38 | 1.56 | .008 | .001 | 2.45 | 2.47 | .29 | .08 | .010 | .019 | Bal. |
| Nominal composition | .050 | .40 | 1.50 | ≦.015 | ≦.003 | 2.50 | 2.50 | .30 | ≦.20 | .015 | ≦.015 | " |

The steel was casted an rolled to round bars, diameter 76 mm, at a low final rolling temperature. The rods were cut up into lengths, bent to links of a chain and were butt welded by electric resistance welding.

Figure 2:
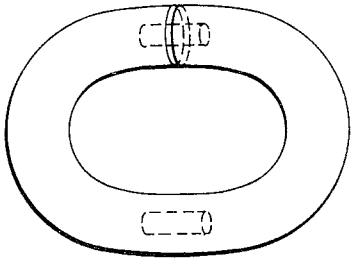

The welded links were heat treated twice; first in a continuous furnace at 900° C. (normalising) followed by cooling in air to room temperature, and thereafter at about 730° C. (duplex annealing), which was also followed by cooling in air to room temperature. The links were proof strained at 4730 kN, whereafter test specimens were taken out in the weld joint and in the back of the links, FIG. 2.

The following strength properties were measured at tensile testing and impact toughness testing.

TABLE 6

| | Tensile testing | | | |
|---|---|---|---|---|
| | Rp0.2 MPa | Rm MPa | A5 % | Z % |
| Back | 715 | 1010 | 17 | 64 |
| Joint | 838 | 994 | 16 | 59 |

| Impact toughness testing | | |
|---|---|---|
| Temp °C. | KV, Joule Back | Joint |
| +80 | | 137 |
| +60 | | 120 |
| +40 | | 140 |
| +20 | | 100 |
| ±0 | | 124 |
| −20 | 180 | 112 |
| −40 | | 157 |
| −60 | | 75 |
| −76 | | 61 |

I claim:

1. Welded chain made from a steel having good weldability and hardenability, a yield point of at least 600 MPa, a rupture limit of at least 900 MPa at room temperature and an impact toughness of at least 40 Joule at −20° C., said steel having the following chemical composition as % by weight:

C: 0.03–0.07
Si: 0.01–1
Mn: max 2.5
Cr: 1.8–3
Ni: 1.5–3
Mo: max 0.5
Nb, V, Ti total 0.0–0.10 wherein the total of Mn+Cr is from about 3 to about 5 remainder essentially only iron and impurities in normal amounts;

the welded chain having been subjected to heat treatment comprising normalizing at a temperature between 800° and 1000° C., cooling to room temperature, and thereafter duplex annealing at a temperature between about 680° and 790° C.

2. Chain of claim 1, wherein the ratio of percent Mn/percent Cr is at most about 1.0.

3. Chain of claim 1, wherein the cooling of the normalized chain is in air or water.

4. Chain of claim 1, wherein the steel contains 1.5 to 2.5 weight percent Mn.

5. Chain of claim 1, wherein the steel contains 1.2–2.0 percent Mn and 1.8–2.8 percent Cr.

6. Chain of claim 5, wherein said steel contains 1.3–1.7 percent Mn and 2.1–2.7 percent Cr.

7. Chain of claim 1, wherein the ratio of percent Mn/percent Cr is between 0.5 and 1.0.

8. Steel of claim 7, wherein said ratio is between 0.5 and 0.75, and the sum of Mn+Cr is between 3.5 and 4.5 percent.

9. Chain of claim 1, wherein the steels contains 1.5–2.5 percent Ni.

10. Chain of claim 1, wherein the steel contains 2.0–3.0 percent Ni.

11. Chain of claim 1, wherein the steel contains at least 0.1 percent Mo and the contents of niobium, vanadium and titanium do not exceed impurity levels.

12. Chain of claim 11, wherein the steel contains 0.2–0.4 percent Mo.

13. Chain of claim 1, wherein the steel contains 0.2–0.4 percent Si.

14. Chain of claim 1, wherein the steel contains 0.005–0.04 percent Al.

15. Chain of claim 14, wherein the steel contains 0.01–0.02 percent Al.

16. Chain of claim 1, wherein the steel contains no more than 0.05 percent N.

17. Chain of claim 1, wherein the steel has the following composition in percent by weight:

C: 0.030–0.070;
Si: 0.25–0.55;
Mn: 1.3–1.7;
Cr: 2.10–2.70;
Ni: 2.35–3.00;
Mo: 0.25–0.40;
Cu: max 0.20;
Al: 0.010–0.025;
N: max 0.04,
remainder iron and impurities in normal amounts.

* * * * *